US009631420B2

(12) United States Patent
Regenold

(10) Patent No.: US 9,631,420 B2
(45) Date of Patent: Apr. 25, 2017

(54) GARAGE DOOR OPENER PROTECTIVE SHIELD

(71) Applicant: Charles S. Regenold, Minnetonka, MN (US)

(72) Inventor: Charles S. Regenold, Minnetonka, MN (US)

( * ) Notice: Subject to any disclaimer, the term of this patent is extended or adjusted under 35 U.S.C. 154(b) by 0 days.

(21) Appl. No.: 15/016,412

(22) Filed: Feb. 5, 2016

(65) Prior Publication Data

US 2016/0230445 A1 Aug. 11, 2016

Related U.S. Application Data

(60) Provisional application No. 62/119,337, filed on Feb. 23, 2015, provisional application No. 62/113,210, filed on Feb. 6, 2015, provisional application No. 62/112,409, filed on Feb. 5, 2015.

(51) Int. Cl.

| | |
|---|---|
| ***E06B 5/11*** | (2006.01) |
| ***E05B 17/20*** | (2006.01) |
| ***E05B 65/00*** | (2006.01) |
| *E05F 15/668* | (2015.01) |

(52) U.S. Cl.

CPC ..... *E06B 5/113* (2013.01); *E05B 17/2003* (2013.01); *E05B 65/0021* (2013.01); *E05F 15/668* (2015.01)

(58) Field of Classification Search

IPC ..... E05B 17/2084,13/001, 65/0021; E06B 5/113; E05C 19/18

See application file for complete search history.

(56) References Cited

U.S. PATENT DOCUMENTS

| | | | | |
|---|---|---|---|---|
| 3,507,313 | A * | 4/1970 | Stockslager | F16B 39/284 411/284 |
| 4,442,631 | A | 4/1984 | Weber | |
| 4,794,732 | A | 1/1989 | Elardi | |
| 4,805,344 | A | 2/1989 | Hrboka | |
| 4,905,542 | A | 3/1990 | Burm et al. | |
| 5,533,561 | A | 7/1996 | Forehand, IV | |
| 5,544,924 | A * | 8/1996 | Paster | E05B 15/0006 160/201 |
| 6,273,174 | B1 | 8/2001 | Singleton | |
| 6,834,464 | B2 | 12/2004 | Shoemaker | |
| 7,665,504 | B2 * | 2/2010 | Schulze | E05F 15/668 16/DIG. 1 |
| 8,403,022 | B2 | 3/2013 | Womacks | |
| 8,453,706 | B2 | 6/2013 | Shepherd | |
| 8,495,897 | B1 | 7/2013 | Koc | |
| 8,936,064 | B1 | 1/2015 | Diaz | |

(Continued)

*Primary Examiner* — Gregory Strimbu

(74) *Attorney, Agent, or Firm* — Mitchell A. Rossman; Terra Nova Patent Law, PLLC

(57) ABSTRACT

A garage door opener protective shield system for preventing unauthorized a garage in combination with a garage door and a garage door opener. The garage door opener protective shield system includes a protective shield having a notch to allow for the protective shield to be positioned adjacent to and perpendicular to each side of a garage door carriage or a notch and a crease to allow for the protective shield to be positioned in front of and perpendicular to the garage door carriage; one or more rows of mounting tabs; and one or more fasteners to secure the protective shield to a door arm.

12 Claims, 4 Drawing Sheets

(56) References Cited

U.S. PATENT DOCUMENTS

| | | | | |
|---|---|---|---|---|
| 2006/0081262 | A1* | 4/2006 | Vega | A61F 9/06<br>128/857 |
| 2012/0019011 | A1 | 1/2012 | Laborde | |
| 2015/0184421 | A1* | 7/2015 | Schulte | E05B 13/001<br>292/346 |

* cited by examiner

GARAGE DOOR OPENER PROTECTIVE SHIELD

RELATED APPLICATIONS

This application claims priority to U.S. Provisional Patent Application Ser. No. 62/119,337 filed Feb. 23, 2015, to U.S. Provisional Patent Application Ser. No. 62/113,210 filed Feb. 6, 2015, and to U.S. Provisional Patent Application Ser. No. 62/112,409 filed Feb. 5, 2015, all of which are hereby incorporated by reference in their entirety for all purposes.

BACKGROUND OF THE INVENTION

Garage doors powered by electric garage door openers can be easily broken into from the outside. For example, a thief inserts a wire (e.g., coat hanger) into the opening between the garage door frame and the garage door to disengage the safety release in under a minute. Although this problem has been known for many years, no suitable solution has yet been proposed.

What is needed is device that prevents this type of break-in.

SUMMARY OF THE INVENTION

The present invention provides a garage door opener protective shield system that protects the garage door opener from being released by a wire from outside of the garage. The garage door opener protective shield system is mounted against the garage assembly and secured by, for example, mounting bolts.

The present invention provides a garage door opener protective shield system for preventing unauthorized access to a dwelling in combination with a garage door and a garage door opener having a track, a carriage slidably mounted on the track, an operating device, a door arm connecting the carriage to the garage door, and a release arm located beneath the carriage and extending downward there from for manually releasing the garage door from the operating device. The garage door opener protective shield system includes: a protective shield having a first side, a second side, a first edge, a second edge, a third edge, and a fourth edge, wherein the protective shield includes: a foldable notch on the first edge to allow for the protective shield to be positioned adjacent to and perpendicular to each side of the carriage or a first notch on the first edge and a foldable crease parallel to the first edge to allow for the protective shield to be folded toward the second side to be positioned in front of and perpendicular to the carriage; and one or more rows of mounting tabs; and one or more fasteners to secure the protective shield to the door arm using the one or more rows of mounting tabs.

In one embodiment, the protective shield includes: a first notch on the first edge to allow for the protective shield to be positioned adjacent to and perpendicular to each side of the carriage. In one embodiment, the protective shield includes one or more second notches along the first edge.

In one embodiment, the protective shield includes: a first notch on the first edge and a foldable crease parallel to the first edge to allow for the protective shield to be folded toward the second side to be positioned in front of and perpendicular to the carriage. In one embodiment, the protective shield includes one or more second notches along the second edge, the third edge, the fourth edge, or a combination thereof.

In one embodiment, the garage door opener protective shield system further includes a cover plate having a first side, a second side, a first edge, a second edge, a third edge, and a fourth edge. In one embodiment, the cover plate includes one or more bendable tabs each independently along the second edge and the fourth edge. In one embodiment, the one or more bendable tabs are bended perpendicular toward the second side and each independently inserted into one or more cavities in the protective shield that are each independently created when the one or rows of mounting tabs are folded perpendicular toward the second side of the protective shield. In one embodiment, the one or more bendable tabs are bent for a second time inward toward the door arm to secure the cover plate to the protective shield. In one embodiment, the one or more fasteners include a combination of one or more machine screws, one or more washers, and one or more locking nuts. In one embodiment, the one or more rows of mounting tabs are positioned along a center of the protective shield. In one embodiment, the one or more rows of mounting tabs are positioned symmetrically along a center of the protective shield.

The present invention provides a garage door opener protective shield system for preventing unauthorized access to a dwelling in combination with a garage door and a garage door opener having a track, a carriage slidably mounted on the track, an operating device, a door arm connecting the carriage to the garage door, and a release arm located beneath the carriage and extending downward there from for manually releasing the garage door from the operating device. The garage door opener protective shield system includes: a protective shield having a first side, a second side, a first edge, a second edge, a third edge, and a fourth edge, wherein the protective shield includes: a first notch on the first edge to allow for the protective shield to be positioned adjacent to and perpendicular to each side of the carriage; one or more second notches along the first edge; and one or more rows of mounting tabs located symmetrically along a center of the protective shield; and one or more fasteners to secure the protective shield to the door arm using the one or more rows of mounting tabs.

In one embodiment, the protective shield includes one or more second notches along the second edge, the third edge, the fourth edge, or a combination thereof. In one embodiment, the garage door opener protective shield system further includes a cover plate having a first side, a second side, a first edge, a second edge, a third edge, and a fourth edge. In one embodiment, the cover plate includes one or more bendable tabs each independently along the second edge and the fourth edge. In one embodiment, the one or more bendable tabs are beaded perpendicular toward the second side and each independently inserted into one or more cavities in the protective shield that are each independently created when the one or rows of mounting tabs are folded perpendicular toward the second side of the protective shield. In one embodiment, the one or more bendable tabs are bent for a second time inward toward the door arm to secure the cover plate to the protective shield. In one embodiment, the one or more fasteners include a combination of one or more machine screws, one or more washers, and one or more locking nuts.

The present invention provides a garage door opener protective shield system for preventing unauthorized access to a dwelling in combination with a garage door and a garage door opener having a track, a carriage slidably mounted on the track, an operating device, a door arm connecting the carriage to the garage door, and a release arm located beneath the carriage and extending downward there from for manually releasing the garage door from the operating device. The garage door opener protective shield system includes: a protective shield having a first side, a second side, a first edge, a second edge, a third edge, and a fourth edge, wherein the protective shield includes: a first notch on the first edge and a foldable crease parallel to the first edge to allow for the protective shield to be folded toward the second side to be positioned in front of and perpendicular to the carriage; one or more second notches along the first edge; and one or more rows of mounting tabs located symmetrically along a center of the protective shield; and one or more fasteners to secure the protective shield to the door arm using the one or more rows of mounting tabs.

In one embodiment, the protective shield includes one or more second notches along the second edge, the third edge, the fourth edge, or a combination thereof. In one embodiment, the garage door opener protective shield system further includes a cover plate having a first side, a second side, a first edge, a second edge, a third edge, and a fourth edge. In one embodiment, the cover plate includes one or more bendable tabs each independently along the second edge and the fourth edge.

In one embodiment, the one or more bendable tabs are bended perpendicular toward the second side and each independently inserted into one or more cavities in the protective shield that are each independently created when the one or rows of mounting tabs are folded perpendicular toward the second side of the protective shield. In one embodiment, the one or more bendable tabs are bent for a second time inward toward the door arm to secure the cover plate to the protective shield, in one embodiment, the one or more fasteners include a combination of one or more machine screws, one or more washers, and one or more locking nuts.

BRIEF DESCRIPTION OF THE DRAWINGS

Embodiments of the invention may be best understood by referring to the following description and accompanying drawings, which illustrate such embodiments. In the drawings.

Figure 1:
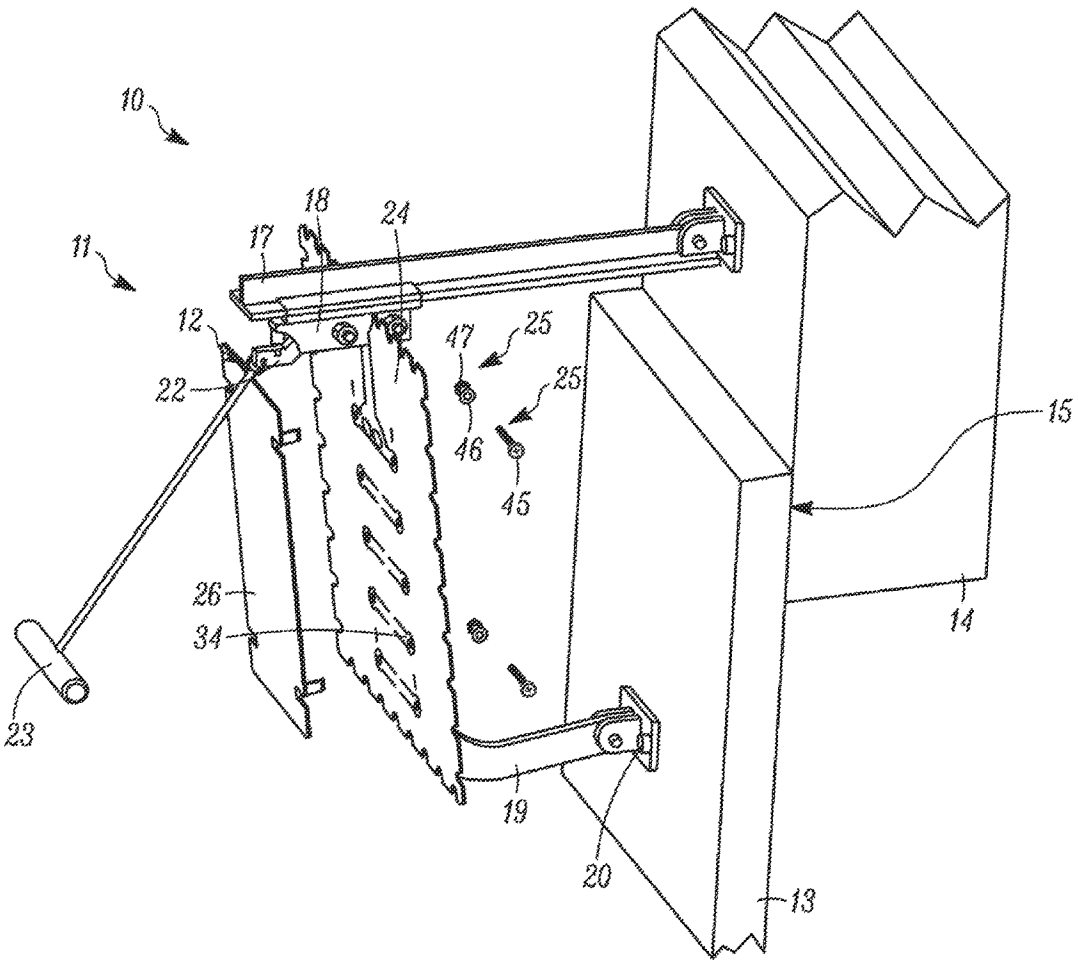
FIG. 1 is a perspective drawing illustrating an exemplary garage door opener protective shield system in standard installation mode.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a garage door opener protective shield system that protects the garage door opener from being released by a wire from outside of the garage. The garage door opener protective shield system is mounted against the garage assembly and secured by, for example, mounting bolts.

The present invention provides a garage door opener protective shield system for preventing unauthorized access to a dwelling in combination with a garage door and a garage door opener having a track, a carriage slidably mounted on the track, an operating device, a door arm connecting the carriage to the garage door, and a release arm located beneath the carriage and extending downward there from for manually releasing the garage door from the operating device. The garage door opener protective shield system includes: a protective shield having a first side, a second side, a first edge, a second edge, a third edge, and a fourth edge, wherein the protective shield includes: a first notch on the first edge to allow for the protective shield to be positioned adjacent to and perpendicular to each side of the carriage or a first notch on the first edge and a foldable foldable crease parallel to the first edge to allow for the protective shield to be folded toward the second side to be positioned in front of and perpendicular to the carriage; one or more second notches along the first edge; and one or more rows of mounting tabs; and one or more one or more fasteners to secure the protective shield to the door arm using the one or more rows of mounting tabs.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New international Dictionary*, Merriam-Webster Inc., Springfield, Mass., 1993 and *The American Heritage Dictionary of the English Language*, Houghton Mifflin, Boston Mass., 1981.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "comprising" or "comprises" is intended to mean that the compositions and methods include the recited elements, but not excluding others.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the phrase "operatively coupled" refers to bringing two or more items together or into relationship with each other such that they may operate together or allow transfer of information between the two or more items.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The invention illustratively disclosed herein suitably may be practiced in the absence of any element which is not specifically disclosed herein.

Figure 2:
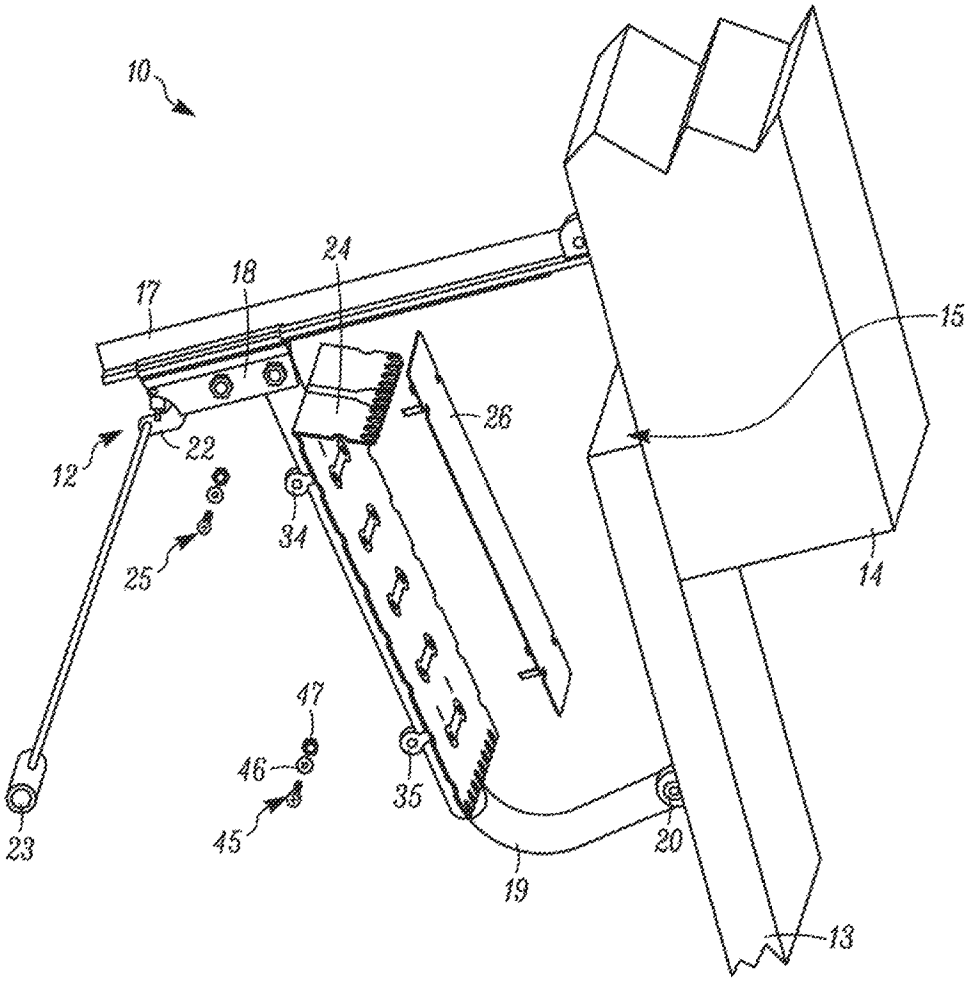
FIG. 2 is a perspective drawing illustrating an exemplary garage door opener protective shield system in reverse installation mode.

FIGS. 1-2 are perspective drawings illustrating an exemplary garage door opener protective shield system 10 that fits in front of the garage door opener 11 to prevent unauthorized activation of the garage door release system 12. The garage door opener 11 includes a garage door 13 installed within a garage (not shown). The front of the garage includes a door frame header 14. The garage door opener 11 is anchored to the roof of the garage and is operatively engaged with the garage door 13 to allow the garage door 13 to open and close. A small space 15 may be present between the garage door 13 and the door frame header 14. A rubber strip (not shown) extends in the space 15 to prevent air from entering the garage.

The garage door opener 11 includes a drive train (not shown), which includes a track 17, a carriage 18 mounted on the track 17, and a power source (not shown), which pulls the carriage 18 rearward to open the garage door 13. The carriage 18 is attached to the garage door 13 with a door arm 19. The door arm 19 is attached to the garage door 13 with a vertical bracket 20 in which the door arm 19 is pivotally attached to both the vertical bracket 20 and the carriage 18. When the garage door 13 is opened, the door arm 19 must pivot at both the vertical bracket 20 and the carriage 18 to ensure the garage door 13 can pivot rearward.

The garage door release system 12 includes a release arm 22 which is pivotally mounted to the carriage 18 at a pivot axle (not shown). A release spring (not shown) connects the release arm 22 to the carriage 18 and biases the release arm 22 toward the carriage 18, causing the release arm 22 to return to its initial position once it has been pulled downward. The release arm 22 must be pulled downward from a point opposite the pivot axle (not shown). Typically, the release arm is located about seven feet above the garage floor. Therefore, a release cord 23 is attached to the release arm 22 opposite the pivot axle (not shown) to allow a person standing inside the garage to easily operate the release arm 22.

The release arm 22 provides a convenient way for the user to manually open the garage door 13. However, it also provides an unauthorized person to reach into the garage door 13 through the small space 15 above the garage door 13 using a hooked item (not shown) and operate the release arm 22.

FIG. 1 illustrates the garage door opener protective shield system 10 in the standard installation mode, which is used for most garage door openers to prevent an unauthorized person from operating the release arm 22. The garage door opener protective shield system 10 includes a protective shield 24, one or more one or more fasteners 25, and a cover plate 26.

Figure 3:
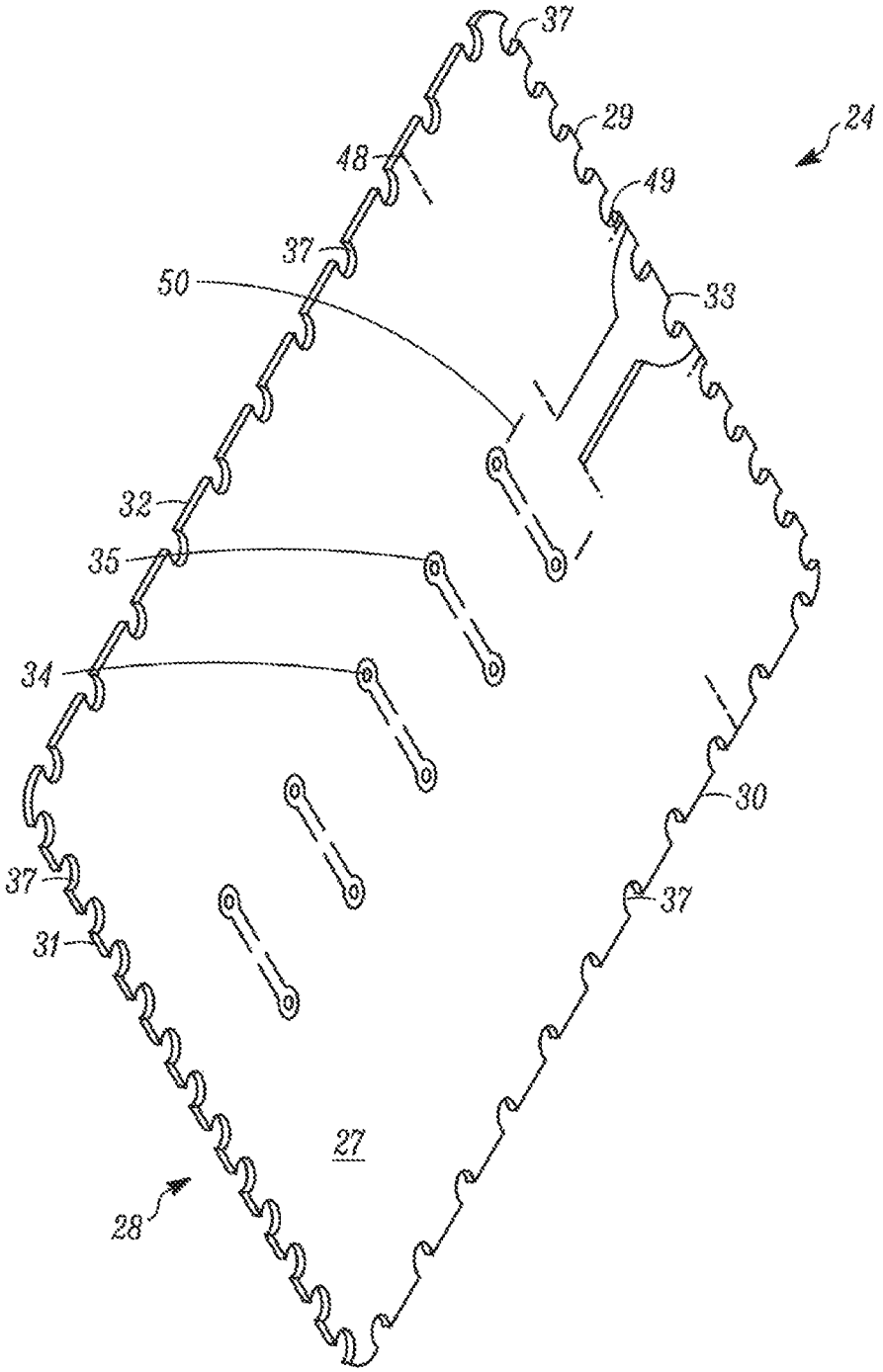
FIG. 3 is a perspective drawing illustrating an exemplary garage door opener protective shield.

The protective shield 24, as shown in FIG. 3, has a first side 27, a second side 28, a first edge 29, a second edge 30, a third edge 31, and a fourth edge 32.

The protective shield 24 includes a first notch 33 in about the middle of the first edge 29 to allow for the protective shield 24 to be positioned adjacent to and perpendicular to each side of the carriage 18.

The protective shield 24 also includes one or more rows of mounting tabs 34 along the center of the protective shield 24.

The one or rows of mounting tabs 34 allow for the attachment of the protective shield 24 to the door arm 19 so that the protective shield 24 is positioned adjacent to and perpendicular to the carriage 18.

The one or rows of mounting tabs 34 each independently include two or more holes 35. When the one or rows of mounting tabs 34 are folded perpendicular toward the second side 28, the one or rows of mounting tabs 34 each independently contact each side of the door arm 19 and allow for one or more fasteners 25 to penetrate the two or more holes 35 in front of the door arm 19 to secure the protective shield 24 to the door arm 19.

The protective shield 24 further includes one or more second notches 37 along the first edge 29, one or more second notches 37 along the second edge 30, one or more second notches 37 along the third edge 31, and one or more second notches 37 along the fourth edge 32.

The one or more second notches 37 serve to catch any unauthorized hooked item (not shown) that may be inserted through the small space 15 above the garage door 13 and moved along the top or sides of the protective shield 24 and thereby prevent the unauthorized hooked item (not shown) from catching upon and operating the release arm 22.

Figure 4:
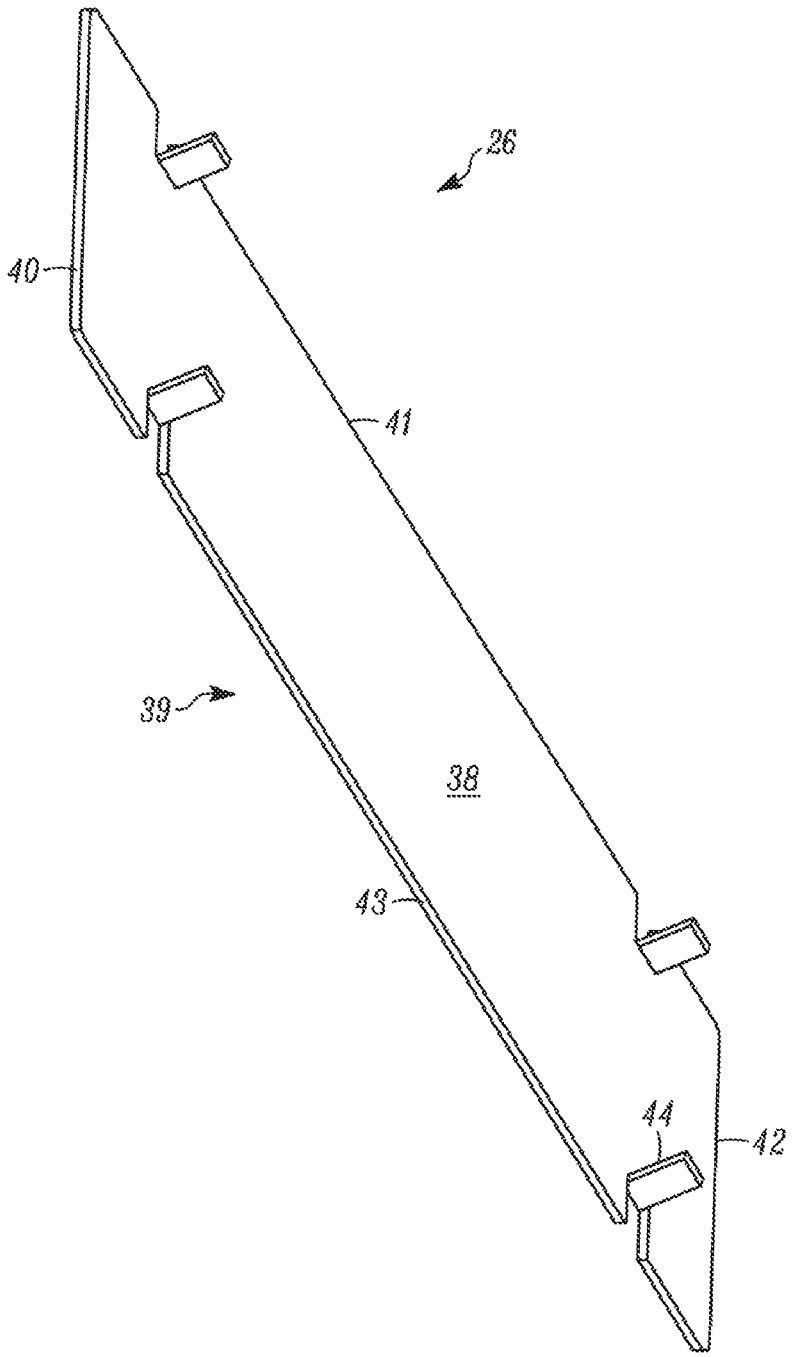
FIG. 4 is a perspective drawing illustrating an exemplary garage door opener protective shield system cover plate.

The cover plate 26, as shown in FIG. 4, has a first side 38, a second side 39, a first edge 40, a second edge 41, a third edge 42, and a fourth edge 43. The second edge 41 and the fourth edge 43 each independently include one or more bendable tabs 44. The one or more bendable tabs 44 may be bent perpendicular toward the first side 38 and each independently inserted into the one or more cavities in the protective shield 24 that are each independently created when the one or rows of mounting tabs 34 are folded perpendicular toward the second side 28. Then, the one or more bendable tabs 44 are bent for a second time inward toward the door arm 19 to secure the cover plate 26 to the protective shield 24.

The one or more fasteners 25 may include a combination of one or more machine screws 45, one or more washers 46, and one or more locking nuts 47.

FIG. 2 illustrates the garage door opener protective shield system 10 in the reverse installation mode, which is used for garage door openers where the drive chain hangs below the track 17 or if the release arm 22 is too close to the door arm 19.

The protective shield 24 includes a first notch 33 in about the middle of the first edge 29 and a first foldable crease 48 and a second foldable crease 49, both of which are bent toward the second side 28, to allow for the protective shield 24 to be positioned in front of and perpendicular to the carriage 18. The protective shield 24 further includes a third foldable crease 50 on each side of the first notch 33.

The protective shield 24 also includes one or more rows of mounting tabs 34 along the center of the protective shield 24.

The one or rows of mounting tabs 34 allow for the attachment of the protective shield 24 to the door arm 19 so that the protective shield 24 is positioned in front of and perpendicular to the carriage 18.

The one or rows of mounting tabs 34 each independently include two or more holes 35. When the one or rows of mounting tabs 34 are folded perpendicular toward the first side 27, the one or rows of mounting tabs 34 each independently contact each side of the door arm 19 and allow for one or more fasteners 25 to penetrate the two or more holes 35 behind the door arm 19 to secure the protective shield 24 to the door arm 19.

The protective shield 24 further includes one or more second notches 37 along the first edge 29, one or more second notches 37 along the second edge 30, one or more second notches 37 along the third edge 31, and one or more second notches 37 along the fourth edge 32.

The one or more second notches 37 serve to catch any unauthorized hooked item (not shown) that may be inserted through the small space 15 above the garage door 13 and moved along the top or sides of the protective shield 24 and thereby prevent the unauthorized hooked item (not shown) from catching upon and operating the release arm 22.

The cover plate 26 has a first side 38, a second side 39, a first edge 40, a second edge 41, and a third edge 42, and a fourth edge 43. The second edge 41 and the fourth edge 43 each independently include one or more bendable tabs 44. The one or more bendable tabs 44 may be bended perpendicular toward the second side 39 and each independently inserted into the one or more cavities in the protective shield 24 that are each independently created when the one or rows of mounting tabs 34 are folded perpendicular toward the first side 27. Then, the one or more bendable tabs 44 are bent for a second time inward toward the door arm 19 to secure the cover plate 26 to the protective shield 24.

The one or more fasteners 25 may include a combination of one or more machine screws 45, one or more washers 46, and one or more locking nuts 47.

Similarly, except as explicitly required by claim language, a single component may meet more than a single functional requirement, provided that the single component fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicant reserves the right to physically incorporate into this specification any and all materials and information from any such patents, applications, publications, scientific articles, web sites, electronically available information, and other referenced materials or documents. Applicant reserves the right to physically incorporate into any part of this document, including any part of the written description, the claims referred to above including but not limited to any original claims.

What is claimed is:

1. A garage door opener protective shield system for preventing unauthorized ingress into a garage in combination with a garage door and a garage door opener having a track, a carriage slidably mounted on the track, an operating device, a door arm connecting the carriage to the garage door, and a release arm located beneath the carriage and extending downward therefrom for manually releasing the garage door from the operating device, the garage door opener protective shield system comprising:

a protective planar shield having a first side, a second side, a first edge, a second edge, a third edge, and a fourth edge, wherein the protective planar shield comprises:

a first notch in the first edge for receiving a portion of the carriage therein;

two rows of foldable mounting tabs; and wherein the protective planar shield comprises second notches extending into the first edge spaced apart from one another along the first edge from one longitudinal end of the first edge to the other longitudinal end of the first edge, extending into the second edge spaced apart from one another along the second edge from one longitudinal end of the second edge to the other longitudinal end of the second edge, extending into the third edge spaced apart from one another along the third edge from one longitudinal end of the third edge to the other longitudinal end of the third edge, and extending into the fourth edge spaced apart from one another along the fourth edge from one longitudinal end of the fourth edge to the other longitudinal end of the fourth edge.

2. The garage door opener protective shield system of claim 1, further comprising a planar cover plate having a first side, a second side, a first edge, a second edge, a third edge, and a fourth edge.

3. The garage door opener protective shield system of claim 2, wherein the planar cover plate comprises one or more foldable tabs in each of the second edge of the planar cover plate and the fourth edge of the planar cover plate.

4. The garage door opener protective shield system of claim 1, further comprising at least one fastener comprising at least one of a machine screw and a locking nut.

5. A garage door opener protective shield system for preventing unauthorized ingress into a garage in combination with a garage door and a garage door opener having a track, a carriage slidably mounted on the track, an operating device, a door arm connecting the carriage to the garage door, and a release arm located beneath the carriage and extending downward therefrom for manually releasing the garage door from the operating device, the garage door opener protective shield system comprising:

a protective planar shield having a first side, a second side, a first edge, a second edge, a third edge, and a fourth edge, wherein the protective planar shield comprises:

a crease parallel to the first edge;

two rows of foldable mounting tabs, wherein the protective planar shield comprises a first notch in the first edge for receiving a portion of the carriage therein, and wherein the protective planar shield comprises second notches extending into the first edge spaced apart from one another along the first edge from one longitudinal end of the first edge to the other longitudinal end of the first edge, extending into the second edge spaced apart from one another along the second edge from one longitudinal end of the second edge to the other longitudinal end of the second edge, extending into the third edge spaced apart from one another along the third edge from one longitudinal end of the third edge to the other longitudinal end of the third edge, and extending into the fourth edge spaced apart from one another along the fourth edge from one longitudinal end of the fourth edge to the other longitudinal end of the fourth edge.

6. The garage door opener protective shield system of claim 5, further comprising a planar cover plate having a first side, a second side, a first edge, a second edge, a third edge, and a fourth edge.

7. The garage door opener protective shield system of claim 6, wherein the planar cover plate comprises one or more foldable tabs in each of the second edge of the planar cover plate and the fourth edge of the planar cover plate.

8. The garage door opener protective shield system of claim 5, further comprising at least one fastener comprising at least one of a machine screw and a locking nut.

9. A garage door opener protective shield system for preventing unauthorized ingress into a garage in combination with a garage door and a garage door opener having a track, a carriage slidably mounted on the track, an operating device, a door arm connecting the carriage to the garage door, and a release arm located beneath the carriage and extending downward therefrom for manually releasing the garage door from the operating device, the garage door opener protective shield system comprising:

a protective planar shield having a first side, a second side, a first edge, a second edge, a third edge, and a fourth edge, wherein the protective planar shield comprises:

a first notch in the first edge for receiving a portion of the carriage therein;

a crease parallel to the first edge;

second notches extending into the first edge spaced apart from one another along the first edge from one longitudinal end of the first edge to the other longitudinal end of the first edge, extending into the second edge spaced apart from one another along the second edge from one longitudinal end of the second edge to the other longitudinal end of the second edge, extending into the third edge spaced apart from one another along the third edge from one longitudinal end of the third edge to the other longitudinal end of the third edge, and extending into the fourth edge spaced apart from one another along the fourth edge from one longitudinal end of the fourth edge to the other longitudinal end of the fourth edge; and two rows of foldable mounting tabs.

10. The garage door opener protective shield system of claim 9, further comprising a planar cover plate having a first side, a second side, a first edge, a second edge, a third edge, and a fourth edge.

11. The garage door opener protective shield system of claim 10, wherein the planar cover plate comprises one or more foldable tabs in each of the second edge of the planar cover plate and the fourth edge of the planar cover plate.

12. The garage door opener protective shield system of claim 9, further comprising at least one fastener comprising at least one of a machine screw and a locking nut.

* * * * *